US005613576A

United States Patent [19]

Lamb

[11] Patent Number: 5,613,576

[45] Date of Patent: Mar. 25, 1997

[54] APPARATUS FOR PREVENTING DRIFT OF AN ELEVATOR CAR STOPPED AT A FLOOR

[75] Inventor: Miles P. Lamb, Chester, N.J.

[73] Assignee: Inventio AG, Hergiswil NW, Switzerland

[21] Appl. No.: 444,216

[22] Filed: May 18, 1995

[51] Int. Cl.[6] ..... B66B 5/26

[52] U.S. Cl. ..... 187/355; 187/360

[58] Field of Search ..... 187/355, 359, 187/360, 351, 354, 356, 357, 358, 377, 378, 379

[56] References Cited

U.S. PATENT DOCUMENTS

| | | | |
|---|---|---|---|
| 885,924 | 4/1908 | Hollinger | 187/354 |
| 940,792 | 11/1909 | Dempsey | 187/354 |
| 943,939 | 12/1909 | Kampfe | 187/354 |
| 1,491,245 | 4/1924 | Quick . | |
| 1,495,242 | 5/1924 | Boze . | |
| 1,773,163 | 8/1930 | Becker | 187/360 |
| 2,856,028 | 10/1958 | Racely | 187/360 |
| 3,252,547 | 5/1966 | Hornedo | 187/360 X |

FOREIGN PATENT DOCUMENTS

| | | | |
|---|---|---|---|
| 0578238 | 1/1994 | European Pat. Off. | 187/360 |
| 685605 | 9/1979 | U.S.S.R. | 187/360 |

*Primary Examiner*—Karen B. Merritt
*Assistant Examiner*—Scott L. Lowe
*Attorney, Agent, or Firm*—Howard & Howard Attorneys

[57] ABSTRACT

A stopping apparatus for preventing drift of an elevator car stopped at a floor is actuated by a car door panel. The apparatus includes an axle rotatably mounted on the car floor, a radially extending operating arm for contact with an edge of the car door panel, at least one radially extending stop arm and a return spring for retracting the stop arm when the car door panel is closed. As the car door panel is opened, the stop arm is rotated adjacent a stop on the wall of the elevator shaft in which the car travels. If the stop is a recess formed in the shaft wall, a free end of the stop arm cooperates with the recess to prevent drift. If the stop is a floor door threshold, two stop arms are provided to prevent drift superposed above and below the threshold.

12 Claims, 2 Drawing Sheets

APPARATUS FOR PREVENTING DRIFT OF AN ELEVATOR CAR STOPPED AT A FLOOR

BACKGROUND OF THE INVENTION

The present invention relates generally to an apparatus for elevator cars and, in particular, to an apparatus for preventing drift of an elevator car when stopped at a floor.

The European patent specification 0 578 238 shows a stopping device for an hydraulic elevator for preventing the downward drift of a the elevator car. A pair of magnetically actuated latches swivel outwardly at a carrier frame of the elevator car. Stop blocks are positioned on the elevator shaft wall and extend into the paths of the actuated latches so that the latches contact the stop blocks to prevent downward movement of the elevator car.

A disadvantage of the above described equipment is that the latches require a complicated magnetically actuated linkage to swing outwardly and retract. Thus, the reliability of the stopping device is impaired. At low car loads, the danger of upward drift exists since the actuated stopping device does not prevent upward movement.

SUMMARY OF THE INVENTION

The present invention concerns a stopping apparatus for preventing drift of an elevator car stopped at a floor. The stopping apparatus includes a generally vertically extending axle rotatably mounted on a floor of an elevator car travelling in an elevator shaft, an operating arm having one end attached to the axle and a free end extending into a path of travel of a car door panel of the elevator car, the path of travel being between an opened position and a closed position of the car door panel, at least one stop arm having one end attached to the axle and an opposite free end and a tension return spring having one end attached to the elevator car floor and an opposite end attached to the stop arm for rotating the free end of the stop arm to a retracted position when the car door panel is moved to the closed position. When the elevator car is stopped adjacent to a floor door and the car door panel is moved to the opened position, the car door panel contacts the operating arm thereby rotating the free end of the stop arm adjacent to a stop on a shaft wall of the elevator shaft, the stop arm and the stop cooperating to prevent drift of the elevator car in at least one direction in the elevator shaft.

In one embodiment, the stop is a floor door threshold extending into the elevator shaft from the shaft wall and the stop arm is an upper stop arm attached to the axle above the floor of the elevator car. Also included is a lower stop arm having one end attached to the axle below the floor of the elevator car and an opposite free end. When the elevator car is stopped adjacent to a floor door and the car door panel is moved to the opened position, the car door panel contacts the operating arm thereby rotating the free ends of the stop arms adjacent to the floor door threshold, the upper stop arm and the threshold cooperating to prevent downward drift of the elevator car in the elevator shaft and the lower stop arm and the threshold cooperating to prevent upward drift of the elevator car in the elevator shaft. A recess can be formed in the shaft wall below the floor door threshold and the lower stop arm elongated to extend into the recess whereby when the elevator car is positioned away from the floor door and the car door panel is moved toward the opened position, the free end of the lower stop arm contacts the shaft wall to prevent the car door panel from moving to the opened position.

The stopping apparatus according to the present invention avoids the disadvantages of the known equipment while meeting safety regulations regarding the movement of an elevator car stopped at a floor.

The advantages of the stopping apparatus according to the present invention are that it has a relatively simple mechanical construction and that is always actuated when the car doors open which is the time of greatest danger to an elevator user.

Furthermore, the stopping apparatus according to the present invention can simultaneously function as a mechanical lock for the car door when the elevator car is not stopped at a floor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
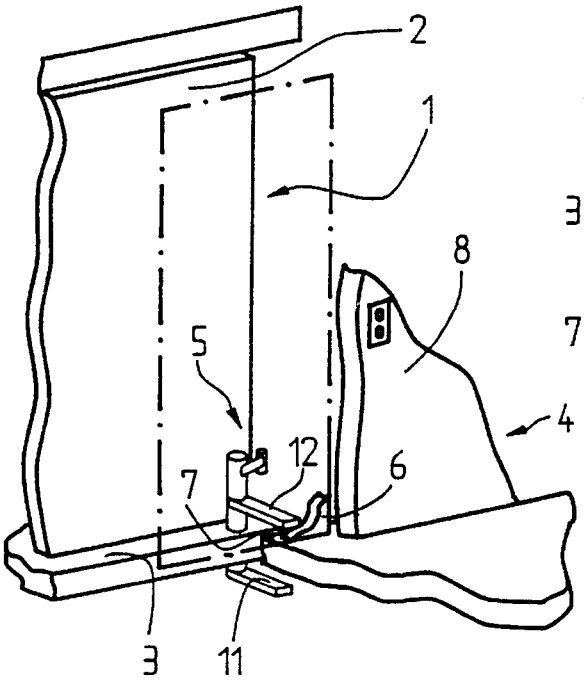
FIG. 1 is a fragmentary perspective view of a schematic representation of an elevator car having a stopping apparatus in accordance with the present invention and stopped at a floor.

In the FIGS. 1 through 6, there is shown an elevator car 1 having at least one horizontally sliding car door panel 2 mounted at an elevator car door opening adjacent a car door threshold 3. The elevator car 1 is shown stopped at a floor 4 of a building and with a stopping apparatus 5 actuated to secure against drift of the elevator car in an upward direction and in a downward direction. The car door panel 2 slides open and closed in the direction of a double headed arrow C shown in the FIG. 2. At the opening of the car door panel 2, the stopping apparatus 5 is actuated into the position shown. As the car door panel 2 slides open, it engages and slides open a floor door panel 6 mounted adjacent a floor door threshold 7. The floor door panel 6 slides open and closed in the direction of a double headed arrow F shown in the FIG. 2. The floor door threshold 7 defines a lower boundary of a door opening in a shaft wall 8 of an elevator shaft 9 in which the elevator car 1 travels.

Figure 2:
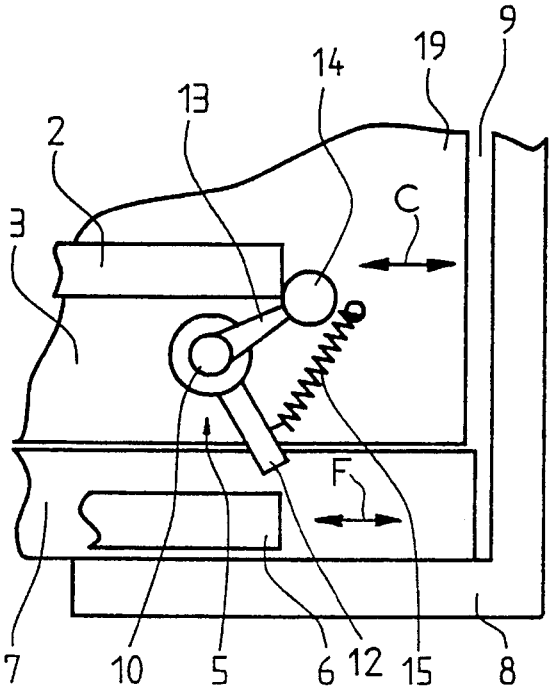
FIG. 2 is an enlarged fragmentary top plan view of the stopping apparatus shown in the FIG. 1.
Figure 3:
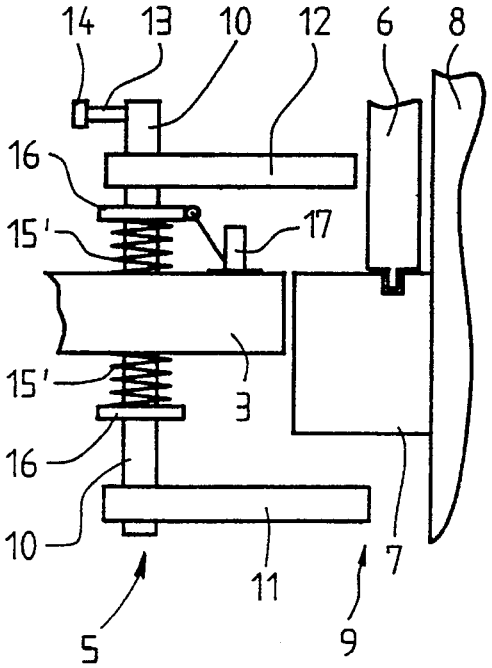
FIG. 3 is an enlarged fragmentary side elevation view of the stopping apparatus shown in the FIG. 1.

As shown in the FIGS. 2 and 3, stopping apparatus 5 includes a generally vertically extending axle 10 rotatably mounted in the car door threshold 3 adjacent to a path of travel of the car door panel 2 and between the car door panel and the floor door threshold 7. A first or lower stop arm 11 has one end attached to and extends radially from a lower end of the axle 10 below the car door threshold 3. A second or upper stop arm 12 has one end attached to and extends radially from a central portion of the axle 10 above the car door threshold 3. An operating arm 13 has one end attached to and extends radially from an upper end of the axle 10. An operating cam 14 is attached to a free end of the arm 13. The arms 11 and 12 extend generally parallel to one another and the arm 13 is positioned approximately 90° counterclockwise from the stop arms. When the elevator car 1 stops at a floor with the car door threshold 3 generally in the same horizontal plane as the floor door threshold 7, the lower stop arm 11 and the upper stop arm 12 can be rotated into position below and above, respectively, the floor door threshold as shown in the FIGS. 1 through 3.

When the car door panel 2 is closed, the free end of the arm 13 with the cam 14 extends into the path of travel of the car door panel. The arm 13 is held in that position by a tension return spring 15 having one end attached adjacent a free end of the upper stop arm 12 and an opposite end attached to a floor 19 of the elevator car 1 as shown in the FIG. 2. Alternatively, the spring 15 can be attached to the lower stop arm 11 or a second return spring (not shown) can be attached to the lower stop arm. Furthermore, the return spring 15 can be replaced by a pair of coil return springs 15' as shown in the FIG. 3. The axle 10 extends through the cushion springs 15' which cushion the car from making hard stops when system is activated. These springs are positioned above and below the car door threshold 3. Each of the springs 15' has one end attached to the threshold 3 and an opposite end attached to an associated retainer plate 16 attached to the axle 10. As the car door panel 2 slides open, an edge of the panel contacts the cam 14 to rotate the axle 10 in a clockwise direction as viewed in the FIG. 2. The rotation of the axle 10 moves the stop arms 11 and 12 in associated horizontal planes to superpose the stop arms below and above the floor door threshold 7 respectively.

Typically, the elevator car 1 is balanced by a counterweight (not shown) corresponding to a half load car. If the weight of the car 1 and its load exceeds the weight of the counterweight when the car is stopped at a floor, the car tends to drift in a downward direction and the upper stop arm 12 engages the floor door threshold 7 thereby stopping the drift. If the weight of the car 1 and its load is less than the weight of the counterweight when the car is stopped at a floor, the car tends to drift in an upward direction and the lower stop arm 11 engages the floor door threshold 7 thereby stopping the drift.

When the car door panel 2 is moved to the close position, the stopping apparatus 5 is retracted by the return spring 15 into a rest position so that the stop arms 11 and 12 do not interfere with the travel of the elevator car 1 in the elevator shaft 9. The position of the stopping apparatus 5 can be sensed by a movement sensor 17 mounted on the car door threshold 3 and engaging, for example, the retainer plate 16 adjacent the upper stop arm 12 as shown in the FIG. 3. The sensor 17 can generate a position signal which can be used by the elevator control (not shown) to ascertain when the stopping apparatus 5 is in the actuated and retracted positions. This sensor also cancels drive power when car drift has occurred to the level of spring compression.

Figure 4:
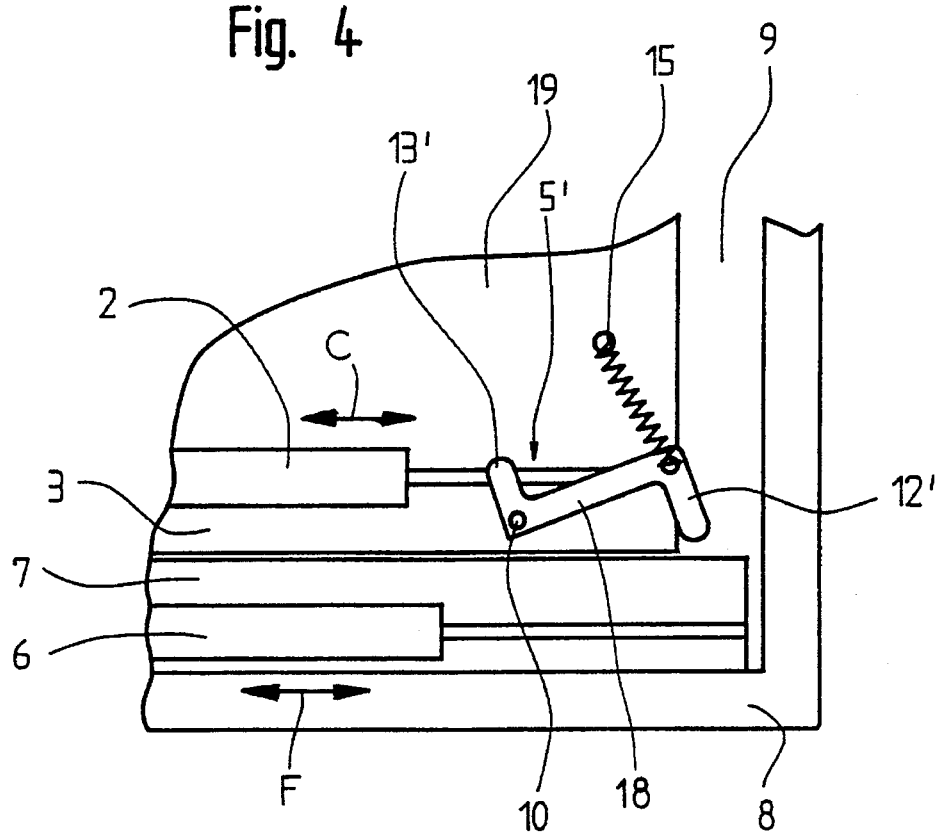
FIG. 4 is a view similar to the FIG. 2 showing an alternate embodiment of the stopping apparatus according to the present invention before actuation.
Figure 5:
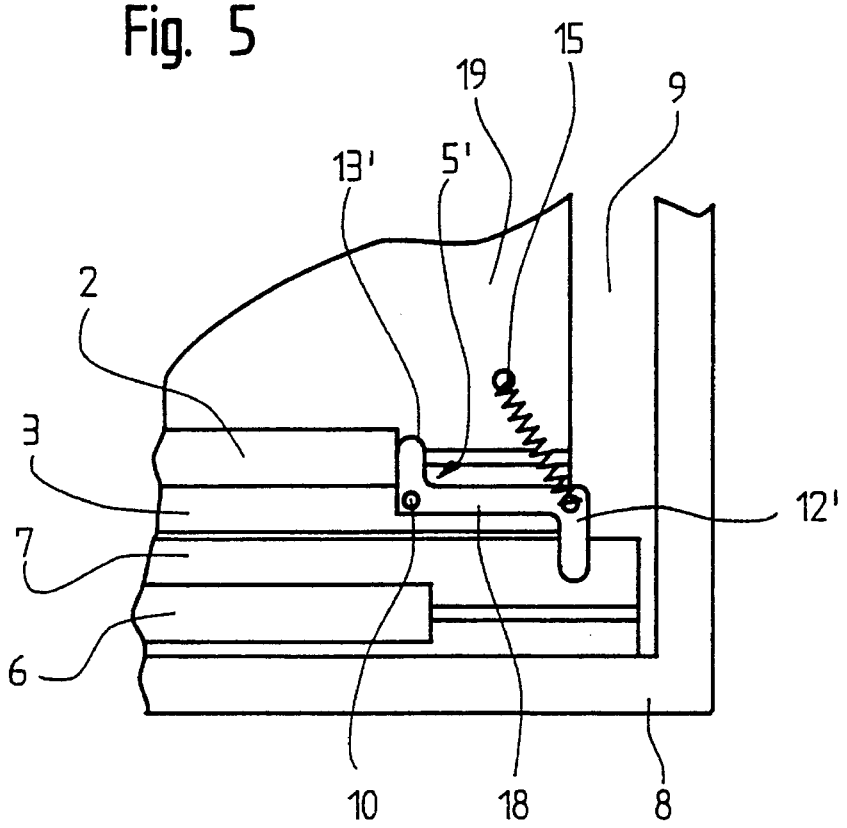
FIG. 5 is a view similar to the FIG. 4 showing the alternate embodiment of the stopping apparatus according to the present invention after actuation.

There is shown in the FIG. 4 and 5 an alternate embodiment of the stopping apparatus according to the present invention. A stopping apparatus 5' includes the generally vertically extending axle 10. An operating arm 13' extends radially from the axle 10 and has a free end positioned in the path of travel C of the car door panel in the retracted position shown in the FIG. 4. An end of the arm 13' attached to the axle 10 is also attached to one end of a connecting arm 18. The connecting arm 18 extends radially from the axle approximately 90° from the operating arm 13' and has an opposite end attached to one end of an upper stop arm 12'. The upper stop arm 12' extends generally parallel to but in the opposite direction from the operating arm 13'. The arm 13' is held in the retracted position by the tension return spring 15 which has one end attached at the junction of the arms 18 and 12' and the opposite end attached to the floor 19 of the elevator car 1. Although not shown, a connecting arm similar to the arm 18 and a lower stop arm similar to the arm 12' are attached to the axle 10 below the car door threshold 3. When the stopping apparatus 5' is actuated by the car door panel 2, as shown in the FIG. 5, the rotation of the axle 10 moves the upper stop arm 12' and the lower stop arm (not shown) in associated horizontal planes to superpose the stop arms above and below the floor door threshold 7 respectively.

Figure 6:
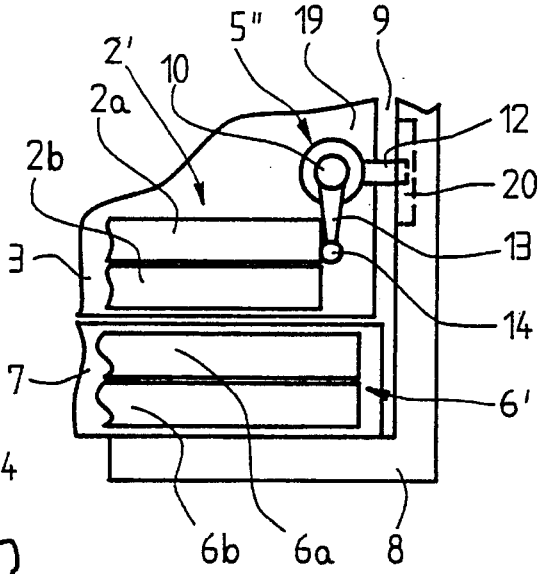
FIG. 6 is a view similar to the FIG. 2 showing a second alternate embodiment of the stopping apparatus according to the present invention after actuation.

A second alternate embodiment of the stopping apparatus according to the present invention is shown in the FIG. 6. A car door panel 2' includes an inner door panel **2*a* and an outer door panel 2*b*. A floor door panel 6' includes an inner door panel 6*a* and an outer door panel 6*b*. The car door panel 2' and the floor door panel 6' are both shown in the open position. A stopping apparatus 5" includes the axle 10, the upper stop arm 12, the operating arm 13 and the operating cam 14 shown in the FIGS. 1 through 3. However, the stopping apparatus 5" is positioned on the car floor 19 on the opposite side of the car door panel 2' from the floor door threshold 7. An edge of the inner door panel 2*a* is in contact with the operating cam 14 thereby actuating the stopping apparatus 5" to the position shown. In the actuated position, the upper stop arm 12 extends beyond a side edge of the car floor 19 into a generally horizontally extending recess 20 formed in an adjacent portion of the shaft wall 8. This embodiment of the stopping apparatus 5" is suitable especially for multipanel telescoping car doors which occupy more space on the car door threshold 3. Although the upper stop arm 12 is shown, the recess could be positioned to cooperate with the lower stop arm 11. Therefore, only one of the stop arms 11 and 12 is required. Furthermore, the recess 20 can be replaced by a guard or stop block (not shown) extending from the wall 8 into the shaft 9 in the manner of the floor door threshold 7 shown in the FIG. 3 in which case both the upper stop arm 12 and the lower stop arm 11** are required to prevent drift.

In the FIGS. 1 through 6, each embodiment of the stopping apparatus according to the present invention is so disposed that as the car door opens, an edge of the car door panel contacts and actuates stopping apparatus shortly before the car door reaches the fully open position. However, the stopping apparatus also can function to lock the car door against fully opening when the car is away from the floor. With reference to the FIGS. 3 and 6, a recess similar to the recess 20 can be formed in the shaft wall 8 below the floor door threshold 7 and the lower stop arm 11 can be lengthened to extend into this recess when the stopping apparatus is actuated. When the car door closes, the stopping apparatus is retracted and the elongated lower stop arm 11 is rotated out of the recess such that the elevator car is free to travel in the elevator shaft 9. When the elevator car is positioned away from the floor door threshold 7, opening of the car door panel 2 will cause rotation of the elongated lower stop arm 11 toward the shaft wall 8. However, the free end of the elongated lower stop arm 11 will strike the shaft wall 8 before the car door panel reaches a fully opened position. Thus, the stopping apparatus functions as a mechanical door lock preventing the car door panel 2 from reaching the fully open position.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for preventing drift of an elevator car stopped at a floor comprising:

a generally vertically extending axle rotatably mounted on a floor of an elevator car travelling in an elevator shaft;

an operating arm having one end attached to said axle and a free end extending into a path of travel of a car door panel of the elevator car, the path of travel being between an opened position and a closed position of the car door panel; and a stop arm having one end attached to said axle and an opposite free end, whereby when the elevator car is stopped adjacent to a floor door and the car door panel is moved to the opened position, the car door panel contacts said operating arm thereby rotating said free end of said stop arm adjacent to a stop on a shaft wall of the elevator shaft, said stop arm and the stop cooperating to prevent drift of the elevator car in at least one direction in the elevator shaft.

2. The apparatus according to claim 1 wherein said free end of said operating arm has an operating cam attached thereto for contact with an edge of the car door panel.

3. The apparatus according to claim 1 including a connecting arm having one end attached to said one end of said operating arm and an opposite end attached to said one end of said stop arm.

4. The apparatus according to claim 1 including a tension return spring having one end attached to the elevator car floor and an opposite end attached to said stop arm for rotating said free end of said stop arm to a retracted position when the car door panel is moved to the closed position.

5. The apparatus according to claim 1 including a movement sensor mounted on the elevator car adjacent said stop arm for generating a signal representing a position of said stop arm.

6. The apparatus according to claim 1 wherein the stop is a floor door threshold extending into the elevator shaft from the shaft wall, said stop arm includes an upper stop arm attached to said axle above the floor of the elevator car and a lower stop arm having one end attached to said axle below the floor of the elevator car and an opposite free end whereby when the elevator car is stopped adjacent to a floor door and the car door panel is moved to the opened position, the car door panel contacts said operating arm thereby rotating said free ends of said stop arms adjacent to the floor door threshold, said upper stop arm and the threshold cooperating to prevent downward drift of the elevator car in the elevator shaft and said lower stop arm and the threshold cooperating to prevent upward drift of the elevator car in the elevator shaft.

7. The apparatus according to claim 1 wherein the stop includes a floor door threshold extending into the elevator shaft from the shaft wall and a recess formed in the shaft wall below the floor door threshold, said stop arm includes an upper stop arm attached to said axle above the floor of the elevator car and a lower stop arm having one end attached to said axle below the floor of the elevator car and an opposite free end whereby when the elevator car is stopped adjacent to a floor door and the car door panel is moved to the opened position, the car door panel contacts said operating arm thereby rotating said free ends of said stop arms adjacent to the floor door threshold, said upper stop arm and the threshold cooperating to prevent downward drift of the elevator car in the elevator shaft and said lower stop arm and the threshold cooperating to prevent upward drift of the elevator car in the elevator shaft, said free end of said lower stop arm extending into the recess, and whereby when the elevator car is positioned away from the floor door and the car door panel is moved toward the opened position, said free end of said lower stop arm contacts the shaft wall to prevent the car door panel from moving to the opened position.

8. The apparatus according to claim 1 wherein the stop is a recess formed in the shaft wall and said free end of said stop arm extends into the recess, the recess and said stop arm cooperating to prevent drift of the elevator car in the elevator shaft.

9. The apparatus according to claim 1 including a coil return spring extending about said axle having one end attached to the elevator car floor and an opposite end attached to said axle for cushioning against a hard stop during drift.

10. The apparatus according to claim 9 including a retainer plate attached to said axle, said opposite end of said coil return spring being attached to said retainer plate.

11. An apparatus for preventing drift of an elevator car stopped at a floor comprising:

a generally vertically extending axle rotatably mounted on a floor of an elevator car travelling in an elevator shaft;

an operating arm having one end attached to said axle and a free end extending into a path of travel of a car door panel of the elevator car, the path of travel being between an opened position and a closed position of the car door panel;

a stop arm having one end attached to said axle and an opposite free end, whereby when the elevator car is stopped adjacent to a floor door and the car door panel is moved to the opened position, the car door panel contacts said operating arm thereby rotating said free end of said stop arm adjacent to a stop on a shaft wall of the elevator shaft, said stop arm and the stop cooperating to prevent drift of the elevator car in at least one direction in the elevator shaft; and a return spring having one end attached to the elevator car floor and an opposite end attached to one of said stop arm and said axle for rotating said free end of said stop arm to a retracted position when the car door panel is moved to the closed position.

12. The apparatus according to claim 11 including a connecting arm having one end attached to said one end of said operating arm and an opposite end attached to said one end of said stop arm and wherein said opposite end of said return spring is attached to said one end of said stop arm.

* * * * *